US006705024B2

(12) United States Patent
Kahl et al.

(10) Patent No.: US 6,705,024 B2
(45) Date of Patent: Mar. 16, 2004

(54) MACHINE FOR PRODUCING A MATERIAL WEB

(75) Inventors: Peter Kahl, Gerstetten (DE); Markus Oechsle, Bartholomae (DE); Roland Mayer, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/855,514

(22) Filed: May 16, 2001

(65) Prior Publication Data

US 2002/0078588 A1 Jun. 27, 2002

(30) Foreign Application Priority Data

May 17, 2000 (DE) ..... 100 24 296

(51) Int. Cl.[7] ..... F26B 11/02
(52) U.S. Cl. ..... 34/126; 34/117; 34/120
(58) Field of Search ..... 34/114, 117, 119, 34/124, 120, 126, 130

(56) References Cited

U.S. PATENT DOCUMENTS 5,214,861 A * 6/1993 Vuorinen ..... 34/114
5,337,490 A 8/1994 Griffin et al.
5,477,624 A * 12/1995 Haessner et al. ..... 34/117
5,860,223 A * 1/1999 Kahl ..... 34/117
5,881,472 A 3/1999 Grunder et al.
5,987,777 A 11/1999 Goebel et al.

FOREIGN PATENT DOCUMENTS

| | | |
|---|---|---|
| DE | 4303315 | 6/1993 |
| DE | 19548303 | 6/1997 |
| EP | 692569 | 1/1996 |
| WO | 00/01884 | 1/2000 |

* cited by examiner

*Primary Examiner*—Pamela Wilson
(74) *Attorney, Agent, or Firm*—Greenblum & Bernstein, P.L.C.

(57) ABSTRACT

A machine for producing a material web is provided having at least one smooth roll at least partially wrapped by the material web. The machine includes an air blowing device arranged for ventilating the material web with at least one discharge stream, wherein the at least one discharge stream is directed into a wedge-shaped opening formed between the at least one at least one roll and the material web leaving the roll.

33 Claims, 2 Drawing Sheets

MACHINE FOR PRODUCING A MATERIAL WEB

CROSS-REFERENCE TO RELATED APPLICATIONS

The present application claims priority under 35 U.S.C. §119 of German Patent Application No. 100 24 296.0, filed on May 17, 2000, the disclosure of which is expressly incorporated by reference herein in its entirety.

BACKGROUND OF THE INVENTION

1. Field of the Invention

The invention relates to a machine for producing a material web, in particular a cardboard or paper web, with at least one smooth roll wrapped by the material web.

2. Discussion of Background Information

In the multi-cylinder drying section of a paper machine, the paper web is guided over steam-heated cylinders or steam-heated cylinders and wire suction rolls for the purpose of drying the web. Especially at the beginning of the drying process, when the moist paper does not yet have sufficient strength, problems often occur with regard to the web guidance, which can especially be attributed to the fact that the moist web sticks to the smooth surfaces, which are absolutely necessary for good heat conduction, and the web is poorly ventilated. In order to be able to remove the web from the cylinders, a sufficient web tension is necessary, which can only be produced by means of pulling, i.e., a corresponding differential speed, before or directly after the first smooth contact surface. This often causes tears and an overstretching of the edges. Because these problems occur more intensely at higher speeds and the tension must be increased, the speed of the paper machine is limited.

SUMMARY OF THE INVENTION

An aspect of the invention is to create an improved machine of the type mentioned at the outset in which the above-mentioned problems are eliminated. Here, it should particularly be achieved that the amount of pulling and/or web tension necessary for removing the web from the smooth roll is reduced.

This aspect is attained according to the invention in that a blowing device is assigned to the roll, whose discharge stream is directed into the wedge-shaped opening between the roll and the material web, for the purpose of ventilating the web. Here, the discharge stream of the blowing device is preferably pointed directly into this wedge-shaped opening.

Because of this construction, an improved ventilation of the material web results, whereby the removal of the web sticking to the roll is facilitated. The blowing device can, in particular, be supplied with air. Preferably, the blowing device includes several discharge openings, in particular, embodied as nozzles, blowing holes, blowing slits, and/or the like.

In a preferred practical embodiment of the machine according to the invention, the blowing device includes at least one blowing tube. The blowing device can extend at least essentially over the entire web width. The discharge stream directed into the wedge-shaped opening of the blowing device is preferably directed slightly against the roll surface.

It is advantageous for the blowing speed of the discharge stream directed into the wedge-shaped opening to be variably adjustable. It can preferably be selected depending on the distance of the blowing device from the wedge-shaped opening. For example, the greater the distance from the wedge-shaped opening, the greater the blowing speed of the discharge stream must be.

The distribution of the discharge openings of the blowing device can vary over the web width. Thus, for example, the distance of the discharge openings in the edge region can be greater than or less than in the middle region. Here, the distance of the discharge openings in the edge region can be greater than or less than in the middle region. Correspondingly, the ventilation can optimally be adapted to the respective conditions such that excessive amounts of air can be prevented.

The blowing device can be integrated into a doctor assigned to the roll or can be attached to such a doctor such that a transfer from the doctor is possible, which means that the web does not run between the doctor and the blowing device in the case of a tear.

It is useful to provide the blowing device with a cover in order to ensure a sufficient protection, in particular from paper scraps. Thus, the possibility of the blowing device becoming a scrap catcher is eliminated.

The position of the doctor should be selected such that, on the one hand, it is arranged sufficiently close to the wedge-shaped opening to ensure sufficient ventilation, and on the other hand, is arranged at a sufficient distance from the wedge-shaped opening to prevent a blockage in the case of a tear.

It is useful to select the size and/or number of discharge openings of the blowing device depending upon the machine speed, the basis weight, the stock, and/or the paper type. Here, the discharge openings, which are, for example, circular, can have a diameter that, in particular, lies in the range of approximately 2 to approximately 12 mm and preferably in the range of approximately 4 to approximately 8 mm.

The blowing speed of the discharge stream of the blowing device is preferably greater than approximately 35 m/s and preferably greater than approximately 50 m/s. Optimal results can especially be achieved at higher air speeds using smaller amounts of air, i.e., no larger amounts of air are necessary.

The rolls in question can be formed, for example, by a drying cylinder. Here, the blowing device is usefully structured and/or insulated such that a thermal deformation and a deviation from the desired blowing direction caused thereby are excluded.

In a useful embodiment, the blowing device simultaneously serves the ventilation of one of the rolls and a hood assigned to the drying cylinder. It can be operated at the air inlet temperature of the hood.

In a preferred embodiment of the machine according to the invention, the roll is formed by the first cylinder of the drying section. However, it is also possible to assign a corresponding blowing device to at least one of the second to fifth cylinders of the drying section.

In a further advantageous embodiment, the roll is formed by a smooth pressing roll. In principle, however, at least one further cylinder and/or at least one further smooth roll can have a corresponding blowing device assigned to it.

According to an aspect of the present invention, the discharge stream of the blowing device is pointed directly into the wedge-shaped opening. According to another aspect of the present invention, the blowing device is supplied with pressurized air. In yet another aspect of the present invention, the blowing device includes several discharge openings formed in particular by nozzles, blowing holes, blowing slits, and/or the like.

In yet another aspect of the present invention, the blowing device includes at least one blowing tube. According to a further aspect of the present invention, the blowing device extends at least essentially over the entire width of the web. In another aspect of the present invention, the discharge stream of the blowing device, which is pointed into the wedge-shaped opening, is pointed slightly against the roll surface.

In another aspect of the present invention, the blowing speed of the discharge stream may be variably adjusted. According to a further aspect of the present invention, the blowing speed of the discharge stream may be selected depending on the distance of the blowing device from the wedge-shaped opening.

According to a still further aspect of the present invention, the distribution of the discharge openings of the blowing device varies over the web width. Other aspects of the invention include the distance of the discharge openings in the edge regions differing from that in the middle regions.

Further aspects of the invention include wherein the distance of the discharge openings in the edge region is less than in the middle region. According to other aspects of the present invention, the distance of the discharge openings in the edge region is greater than in the middle region.

According to another aspect of the present invention, the blowing device is integrated into a doctor assigned to the roll or is attached to such a doctor. According to a further aspect of the present invention, the blowing device is provided with a covering.

In yet another aspect of the invention, the size and/or the number of the discharge openings is selected depending on the machine speed, the base weight, the stock, and/or the paper type. In another aspect of the present invention, the discharge openings, which are circular, for example, have a diameter that lies in a range of approximately 2 to approximately 12 mm and preferably in a range of approximately 4 to approximately 8 mm.

According to a further aspect of the present invention, the blowing speed of the discharge stream of the blowing device is greater than approximately 35 m/s and preferably greater than approximately 50 m/s. In another aspect of the present invention, the roll is formed by a drying cylinder.

According to a still further aspect of the present invention, wherein at the same time, the blowing device serves to ventilate a hood assigned to the roll and/or the drying cylinder. According to a still further aspect of the present invention, the blowing device is operated at the air inlet temperature of the hood. Other aspects of the invention include wherein the roll is formed by the first drying cylinder of a drying section.

Further aspects of the invention include a corresponding blowing device is assigned to at least one of the second to fifth cylinders of a drying section. According to another aspect of the present invention, the roll is formed by a smooth pressing roll. According to a further aspect of the present invention, the blowing device has various zones in the crosswise direction, for example, special zones for the edges. According to a still further aspect of the invention, the blowing device only blows onto the edges.

According to another aspect of the present invention, a machine for producing a material web having at least one smooth roll at least partially wrapped by the material web is provided. The machine includes an air blowing device arranged for ventilating the material web with at least one discharge stream, wherein the at least one discharge stream is directed into a wedge-shaped opening formed between the at least one at least one roll and the material web leaving the roll.

In yet another aspect of the invention, the material web is one of a cardboard or paper web. Additionally, other aspects of the present invention includes wherein the blowing device has at least one discharge opening arranged to form the at least one discharge stream. In another aspect of the present invention, the distance between the discharge openings in the edge regions is less than the distance between the discharge openings in the middle region.

According to a further aspect of the present invention, the distance between the discharge openings in the edge region is greater than the distance between the discharge openings in the middle region.

According to a further aspect of the present invention, at least one of the size and number of the discharge openings is selected depending on at least one of machine speed, basis weight of the material web, the stock, and paper type.

In another aspect of the present invention, the roll includes a drying cylinder. According to a still further aspect of the present invention, at the same time, the blowing device serves to ventilate a hood assigned to at least one of the roll and drying cylinder. In another aspect of the present invention, the roll includes a first drying cylinder of a drying section.

Other aspects of the invention includes wherein the blowing device has various zones in a crosswise direction, with respect to the material web. Further aspects of the invention include various zones which include special zones for edges of the material web. According to other aspects of the present invention, the blowing device only blows onto edges of the material web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
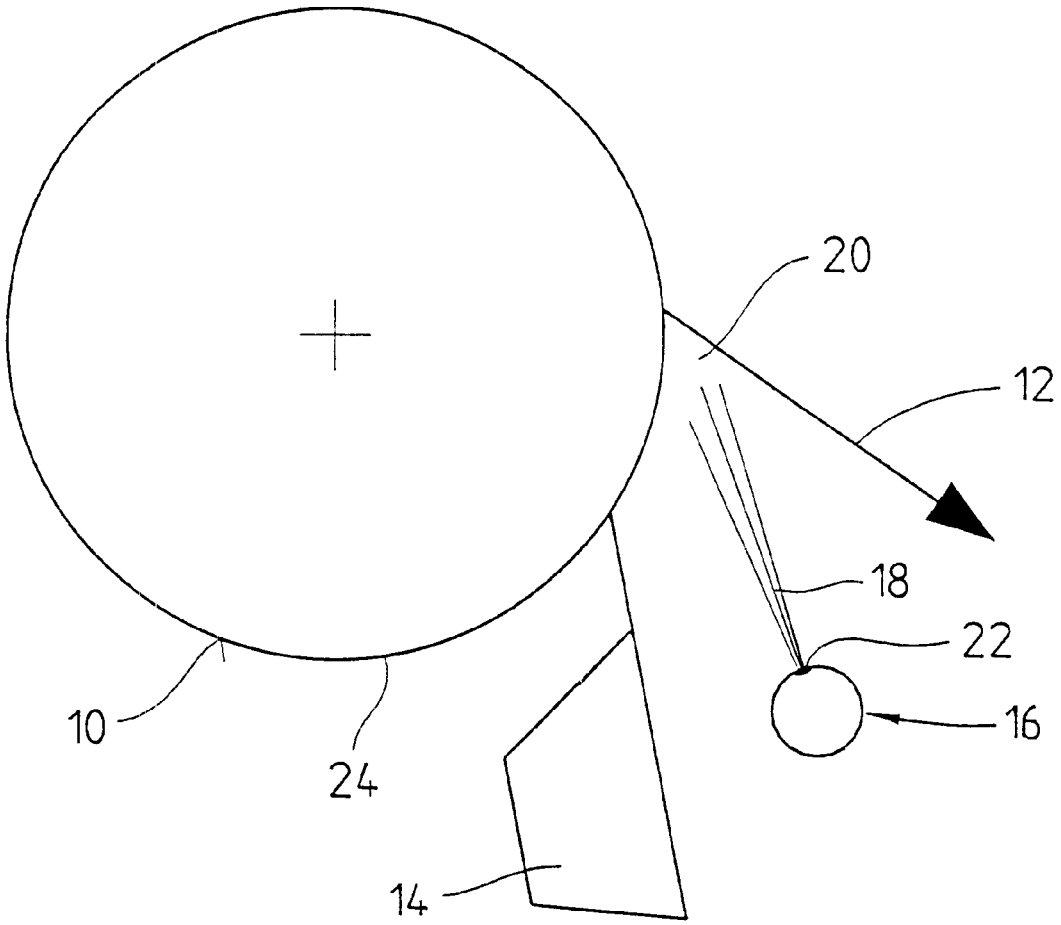
FIG. 1 a schematic depiction of a smooth roll with a doctor and a separate blowing device assigned to it.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1 to 4 each show in a purely schematic depiction a smooth roll 10 of a machine for producing a material web 12, which can, in particular, be a cardboard or paper web. A doctor 14 is assigned to the roll 10 wrapped by the material web 12. The smooth roll 10 can, for example, be a drying cylinder or a smooth pressing roll.

A blowing device 16 is assigned to the roll 10 whose discharge stream 18 is directed into the wedge-shaped opening 20 between the roll 10 and the material web 12 leaving the roll in order to ventilate the material web 12. Here, the discharge stream 18 of the blowing device 16 is pointed directly into the wedge-shaped opening 20.

The blowing device 16 can, in particular, be supplied with pressurized air. It has several discharge openings 22, in particular embodied as nozzles, blowing holes, blowing slits, and/or the like. In the present embodiments, the blowing device 16 includes at least one blowing tube. This blowing tube can extend at least essentially over the entire width of the web.

The discharge stream 18 pointed into the wedge-shaped opening 20 can be directed slightly against the roll surface 24. The blowing speed of the discharge stream 18 can be variably adjustable. It may be selected depending upon the distance of the blowing device 16 from the wedge-shaped opening 20.

The distribution of the discharge openings 22 can vary across the web width. Thus, in particular, the distance of the discharge openings 22 in the edge region can differ from that in the middle region. Here, the distance between the discharge openings 22 in the edge region can be greater than or less than in the middle region.

Figure 4:
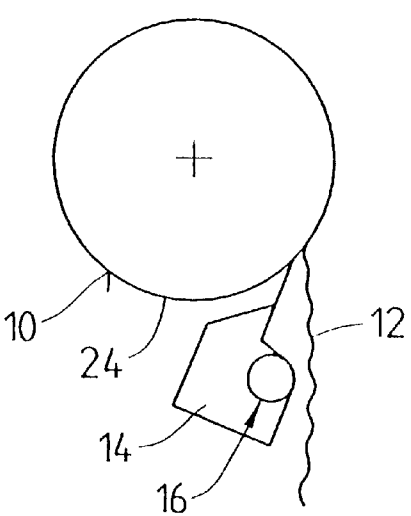
FIG. 4 a schematic depiction of the roll according to FIG. 3 operating with a web tear.
Figure 3:
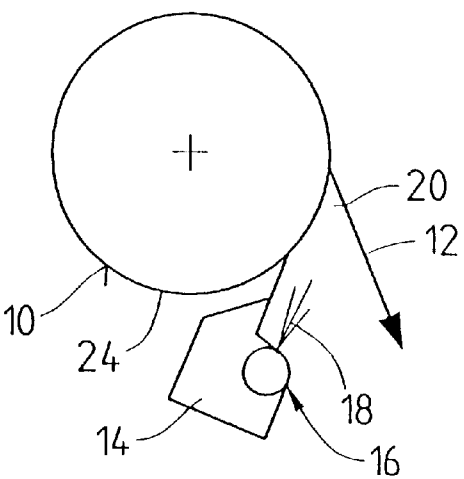
FIG. 3 a schematic depiction of a further embodiment of a smooth roll with a doctor assigned to it and a blowing device integrated into the doctor.
Figure 2:
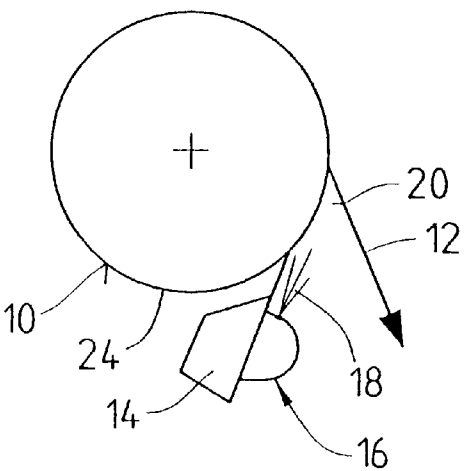
FIG. 2 a schematic depiction of a smooth roll with a doctor assigned to it and a blowing device integrated into the doctor.

The blowing device 16 can be integrated with or attached to the doctor 14 (see, in particular, FIGS. 2 to 4). The blowing device 16 can be provided with a cover (not shown). This prevents the blowing device 16 from becoming a scrap catcher.

It is useful to select the size and/or number of discharge openings 22 depending on the machine speed, the basis weight, the stock, and/or the paper type. The discharge openings 22, which are circular, for example, can have a diameter that lies, in particular, in a range of approximately 2 to approximately 12 mm and preferably in a range of approximately 4 to approximately 8 mm. The blowing speed of the discharge stream 18 can, for example, be greater than approximately 35 m/s and preferably greater than approximately 50 m/s.

If the blowing device 16 is assigned to a roll 10 formed by a drying cylinder, it can simultaneously serve to ventilate a hood assigned to the drying cylinder. Here, the blowing device 16 can be operated at the air inlet temperature of the hood.

While the blowing device 16 is provided separately from the doctor 14 in the embodiment according to FIG. 1, it is integrated into the doctor 14 and/or attached to it in the embodiments shown in FIGS. 2 to 4. FIG. 4 shows the roll 10 operating with a web tear. Here, the blowing device 16 is integrated into the doctor 14 and/or attached to it in such a way that, in this case of a tear, the web 12 does not run between the doctor and the blowing device.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| 10 | Smooth roll, cylinder |
| 12 | Material web |
| 14 | Doctor |
| 16 | Blowing device, blowing tube |
| 18 | Discharge stream |
| 20 | Wedge-shaped opening |
| 22 | Discharge openings |
| 24 | Roll surface |

What is claimed is:

1. A machine for producing a material web having at least one smooth roll at least partially wrapped by the material web, the machine comprising:

an air blowing device arranged for ventilating the material web with at least one discharge stream;

wherein the at least one discharge stream is directed into a wedge-shaped opening formed between the at least one roll and the material web leaving the at least one roll.

2. The machine according to claim 1, wherein the material web is one of a cardboard or paper web.

3. The machine according to claim 1, wherein the discharge stream of the blowing device is pointed directly into the wedge-shaped opening.

4. The machine according to claim 1, wherein the blowing device is supplied with pressurized air.

5. The machine according to claim 1, wherein the blowing device includes at least one discharge opening arranged to form the at least one discharge stream.

6. The machine according to claim 1, wherein said at least one discharge opening comprises at least one of a nozzle, blowing hole and blowing slit.

7. The machine according to claim 1, wherein the blowing device includes at least one blowing tube.

8. The machine according to claim 1, wherein the blowing device extends at least essentially over the entire width of the web.

9. The machine according to claim 1, wherein the discharge stream of the blowing device, which is pointed into the wedge-shaped opening, is pointed slightly against the roll surface.

10. The machine according to claim 1, wherein the blowing speed of the discharge stream may by variably adjusted.

11. The machine according to claim 1, wherein the blowing speed of the discharge stream may be selected depending on the distance of the blowing device from the wedge-shaped opening.

12. The machine according to claim 1, wherein a distribution of the discharge openings of the blowing device varies over the web width.

13. The machine according to claim 12, wherein the distance between the discharge openings in edge regions of the web differs from that in middle regions of the web.

14. The machine according to claim 13, wherein the distance between the discharge openings in the edge regions is less than the distance between the discharge openings in the middle region.

15. The machine according to claim 13, wherein the distance between the discharge openings in the edge region is greater than the distance between the discharge openings in the middle region.

16. The machine according to claim 1, wherein the blowing device is integrated into a doctor assigned to the roll.

17. The machine according to claim 1, wherein the blowing device is attached to a doctor.

18. The machine according to claim 1, wherein the blowing device is provided with a cover.

19. The machine according to claim 1, wherein at least one of the size and number of the discharge openings is selected depending on at least one of machine speed, basis weight of the material web, the stock, and paper type.

20. The machine according to claim 1, wherein the discharge openings are circular.

21. The machine according to claim 20, wherein the discharge openings have a diameter ranging from approximately 2 to approximately 12 mm.

22. The machine according to claim 21, wherein the discharge openings have a diameter ranging from approximately 4 to approximately 8 mm.

23. The machine according to claim 1, wherein a blowing speed of the discharge stream of the blowing device is greater than approximately 35 m/s.

24. The machine according to claim 23, wherein a blowing speed of the discharge stream of the blowing device is greater than approximately 50 m/s.

25. The machine according to claim 1, wherein the roll comprises a drying cylinder.

26. The machine according to claim 1, wherein, at the same time, the blowing device serves to ventilate a hood assigned to at least one of the roll and drying cylinder.

27. The machine according to claim 1, wherein the blowing device is operated at the air inlet temperature of the hood.

28. The machine according to claim 1, wherein the roll comprises a first drying cylinder of a drying section.

29. The machine according to claim 1, wherein a corresponding blowing device is assigned to at least one of a second to fifth cylinders of a drying section.

30. The machine according to claim 1, wherein the roll is formed by a smooth pressing roll.

31. The machine according to claim 1, wherein the blowing device has various zones in a crosswise direction, with respect to the material web.

32. The machine according to claim 31, wherein the various zones comprise special zones for edges of the material web.

33. The machine according to claim 1, wherein the blowing device only blows onto edges of the material web.

* * * * *